United States Patent [19]

Stanish

[11] 3,983,341

[45] Sept. 28, 1976

[54] SIMPLIFIED SLIDE SWITCH

[75] Inventor: Ronald J. Stanish, Hollywood, Fla.

[73] Assignee: AMF Incorporated, White Plains, N.Y.

[22] Filed: June 3, 1975

[21] Appl. No.: 583,466

[52] U.S. Cl. ..... 200/16 D; 200/295; 200/303

[51] Int. Cl.[2] ..... H01H 15/00; H01H 9/02

[58] Field of Search ..... 200/16 C, 16 D, 292, 200/295, 303

[56] References Cited

UNITED STATES PATENTS

| | | | |
|---|---|---|---|
| 2,802,077 | 8/1957 | Taylor | 200/67 |
| 3,072,757 | 1/1963 | Gluck | 200/16 |
| 3,377,454 | 4/1968 | Faggiano | 200/295 |
| 3,525,828 | 8/1970 | Eckhart et al. | 200/16 |
| 3,592,983 | 7/1971 | Kroll | 200/16 |
| 3,596,022 | 7/1971 | Gaber et al. | 200/67 |
| 3,597,564 | 8/1971 | Lewis | 200/303 X |
| 3,674,953 | 7/1972 | Brevick | 200/77 |
| 3,767,870 | 10/1973 | Marquardt | 200/6 |

*Primary Examiner*—James R. Scott
*Attorney, Agent, or Firm*—George W. Price; John H. Gallagher

[57] ABSTRACT

Slide switch in which sliding member which retains sliding contact has side skirts with barbs at bottom edge. Barbs engage and slide on bottom surface of insulator strip on which stationary contacts are mounted.

8 Claims, 3 Drawing Figures

SIMPLIFIED SLIDE SWITCH

BACKGROUND OF THE INVENTION

In the electrical appliance industry there is considerable demand for small, inexpensive, but reliable electrical switches. In the past this demand has been met largely by miniature slide switches that are comprised of a thin, flat insulator base member having two or more stationary contacts on one surface thereof and associated connector terminals extending from the opposite surface. A spring sliding contact is held within the underside of a plastic slide member which is slidable within a metal housing. The housing is stamped from thin sheet metal and has an aperture in its top surface through which extends an actuator button of the slide member. The metal housing has mounting apertures located in extensions on its top surface and also includes side skirts on its two sides. The side skirts extend downwardly over the sides of the plastic slide member and are secured to the insulator base member as by staking. These types of switches have been successfully and extensively used for some time. However, because the metal housing must be stamped and shaped from sheet metal, must be cleaned and plated, and then assembled with the plastic slider and sliding contact, and then staked or otherwise secured to the base member, the selling prices of these switches cannot reasonably be further reduced. The costs associated with the manufacture and handling of the metal housings represent a significant portion of the selling costs of these switches. Accordingly, the elimination of the metal housing would present an opportunity for further reducing the cost of these types of switches.

In U.S. Pat. Nos. 3,525,828 and 3,592,983 slide switches without metal housings are shown for use on printed circuit boards. However, the switches disclosed in those patents are not usable as inexpensive, easy to manufacture, individual slide switches for use on home, garden and shop appliances and tools, and on toys and games, for example.

DETAILED DESCRIPTION OF PREFERRED EMBODIMENT

Figure 1:
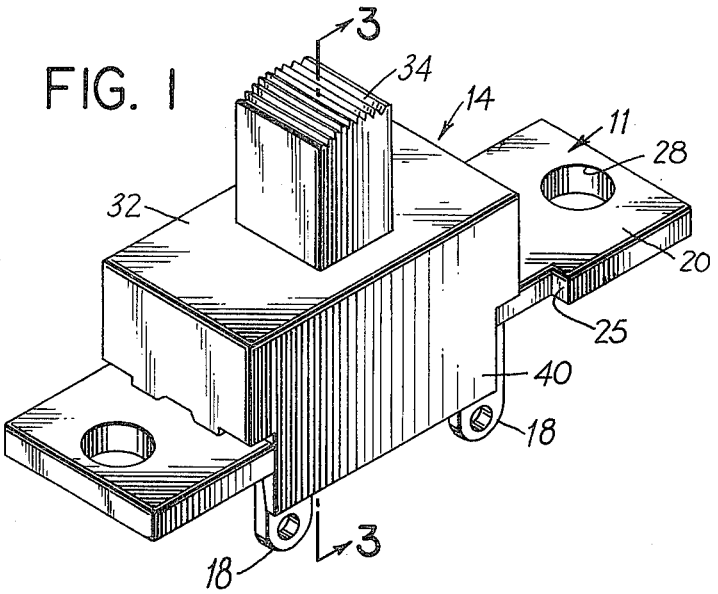
FIG. 1 is a perspective view of the slide switch of this invention.
Figure 3:
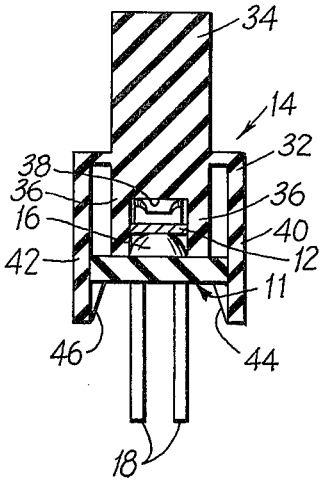
FIG. 3 is a sectional view taken at section 3—3 of FIG. 1.
Figure 2:
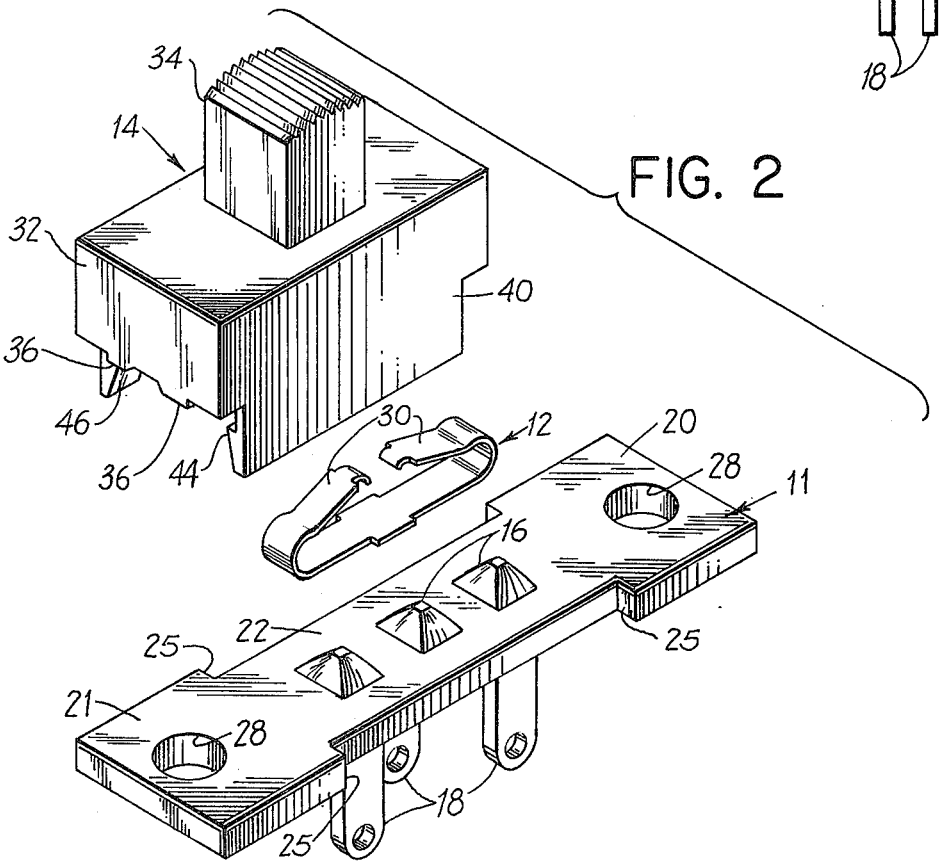
FIG. 2 is an exploded view of the switch of FIG. 1.

Referring in detail to FIGS. 1–3, the simplified slide switch of this invention consists of but three basic members, i.e., an insulator base member 11 having stationary contacts 16 thereon, a sliding contact 12, and a housing member 14.

Except for its shape, insulator base member 11 is substantially identical to base members used in conventional, well known slide switches. As best seen in the exploded view of FIG. 2, insulator base 11 includes the raised or dome-shaped stationary contacts 16 on a face or surface thereof and corresponding connecting terminals 18 extending outwardly from the opposite face or surface. Base member 11 is generally I-shaped in that its two end portions 20 and 21 are wider than its intermediate portion 22. The intermediate portion is of reduced width throughout and beyond the region occupied by stationary contacts 16. The intermediate and end portions of base member 11 meet to form the shoulders 25. Mounting holes 28 are located in each of the end portions 20 and 21.

Sliding contact 12 is adapted to engage the center contact and one end contact of the stationary contacts 16 when in one switching position, and to engage the center one and the other stationary contact when in the other switching position. Sliding contact 12 includes two spring leafs 30. Sliding contact 12 is received within plastic housing member 14 and is resiliently held in contact with stationary contacts 16 when the component parts are assembled.

Housing member 14 is a unitary molded plastic piece having a top portion 32 which, when assembled, extends transversely across the intermediate portion 22 of base member 11. An actuator button 34 is molded as part of the housing member 14. The underside of the top portion 32 has a pair of spaced ridges 36 extending throughout its length. A rectangularly-shaped recess 38 is formed between ridges 36 for receiving sliding contact 12. Housing member 14 includes as a unitary part thereof the rather thin, resilient side skirts 40 and 42 that extend downwardly from the top portion 32. Side skirts 40 and 42 terminate at their lower ends in barb or latch elements 44 and 46, respectively. The barbs or latch elements may extend completely across the bottoms of the side skirts, or alternatively, two or more shorter barbs may be spaced along the bottom of each side skirt.

As illustrated in FIG. 3, sliding spring contact 12 is positioned within rectangularly-shaped recess 38 in housing 14 and is resiliently urged into contact with selected ones of stationary contacts 16. Resilient or yieldable side skirts 40 and 42 extend over the opposite sides of the reduced width intermediate portion 22 of base member 11 and the flat upper edges of the barbs or latch elements 44, 46 are held in sliding contact with the underside of the intermediate portion 22 of the base member 11. The lengths of the yieldable side skirts 40 and 42 are so proportioned and arranged that when the latch elements 40 and 42 are held in sliding engagement with the underside of the base member, the resilient sliding contact 12 is held in compression between the stationary contacts 16 and the rectangularly-shaped recess 38 in the underside of housing member 14.

It also will be noted that the width or longitudinal extent of each side skirt 40 and 42 is shorter than the length of the intermediate portion 22 of base member 11. These widths are proportioned so that shoulders 25 on base member 11 form positive stops that engage the vertical edges of side skirts 40 and 42 and limit the travel of housing member 14 and sliding contact 12. When the vertical edges on the right sides of skirts 40 and 42 are butting against the shoulders 25 at the right end of intermediate section 22 the switch is in one switching position, as illustrated in FIG. 1, and when the vertical edges on the left sides of skirts 40 and 42 are butting against the shoulders at the left end of intermediate section 22 the switch is in its other switching position. It is thus seen that the length of intermediate section 22 establishes the length of the sliding motion of housing member 14.

The component parts of the switch of this invention are extremely simple for an unskilled worker to assemble. No tools, jigs or fixtures are required. The worker holds housing member 14 in an upside-down position and inserts sliding contact 12 in the rectangularly shaped recess 38. One edge of the intermediate portion 22 of base member 11 is placed under the barb or latch element on one side skirt and the worker then presses down on the other side of the intermediate portion of the base member to snap that other side under the barb or latch on the other yieldable side skirt. This completes the assembly operation. Disassembly of the switch is correspondingly as easy.

The single pole double throw switch illustrated in the drawings is but one possible embodiment of the present invention. If desired, the principle of this invention may be applied to multiple pole switches, and/or to single throw or multiple throw switches. For example, the multiple pole and multiple throw switches illustrated in FIGS. 6–8 of U.S. Pat. No. 3,674,953 — Brevick, or any combination thereof, could be constructed in accordance with the teachings of this invention. Furthermore, actuator button 34 need not be located on the top surface of plastic housing member 14. It could just as well be located on an end or a side of top portion 32 of the housing. Also, sliding contact 12 may have a downwardly curved portion in its mid region so as to produce a positive feel and a rocker motion during switching, as taught in U.S. Pat. No. 3,072,757 — Gluck.

Although the type of slide switch illustrated in FIGS. 1–3 having a sliding spring contact is the presently preferred embodiment of this invention, the principles of this invention are equally applicable to a slide switch wherein the movable contact member is a rocker arm which is pivoted at its center region and has a contact on one or both ends thereof. In this type of switch, a plunger or pusher is carried by the slide member and when the pusher is on one side of the pivot of the rocker arm the arm rocks to that side to bring a contact on that end into contact with a corresponding stationary contact. When the pusher is moved across the rocker arm to the other side of the pivot, the movable arm pivots or rocks in the opposite direction to break the first set of contacts and make a second set of contacts which includes a movable contact on the opposite end of the rocker arm. In this type of switch, permanent electrical connection is maintained between a terminal on the base member and the region of the rocker arm at the pivot. This arrangement provides a single pole double throw type of switch. As examples, U.S. Pat. Nos. 2,802,077 — Taylor, 3,596,022 — Gaber et al., and 3,767,870 — Marquardt show rocker type switching mechanisms which may be employed in a switch constructed in accordance with this invention.

What is claimed is:

1. A slide switch comprising a thin insulator base member having two end portions and an intermediate portion therebetween, a plurality of stationary contacts extending from one surface of the base member in said intermediate portion, a plurality of terminal means for said stationary contacts extending from the opposite surface of said base member, a slidable housing member formed as a unitary plastic piece having an upper portion extending transversely of said intermediate portion of the base member and including yieldable side skirts extending downwardly over the sides of said intermediate portion of the base member, one or more barb or latch elements at the lower portion of each side skirt and extending inwardly for slidingly engaging the under side of the intermediate portion of said base member, a movable contact member disposed between the housing member and said stationary contacts and operable in response to the sliding motion of the housing member for selectively making and breaking contact with one or more of said stationary contacts, stop means on said base member for limiting sliding movement of said housing member to the intermediate portion of said base member, said yieldable side skirts being spaced apart relative to the width of said intermediate portion of the base member to maintain said barbs or latching elements in sliding contact with the underside of the base member when said housing member is slid relative to the base member, and said side skirts being sufficiently yielding to permit easy engagement and disengagement of the barbed side skirts with the base member.

2. A slide switch comprising a thin insulator base member having two end portions and an intermediate portion therebetween, a plurality of stationary contacts extending from one surface of the base member in said intermediate portion, a plurality of terminal means for said stationary contacts extending from the opposite surface of said base member, a movable contact member adapted for selective engagement with said stationary contacts, a slidable housing member adapted to selectively hold said movable contact member in engagement with one or more selected ones of said stationary contacts, said housing member being a unitary plastic piece having an upper portion extending transversely of said intermediate portion of the base member and including yieldable side skirts extending downwardly over the sides of said intermediate portion of the base member, one or more barb or latch elements at the lower portion of each side skirt and extending inwardly for slidingly engaging said opposite surface of the intermediate portion of said base member, stop means on said base member for limiting sliding movement of said housing member to the intermediate portion of said base member, said yieldable side skirts being spaced apart relative to the width of said intermediate portion of the base member to maintain said barbs or latching elements in sliding contact with said opposite surface of the base member when said housing member is slid relative to the base member, and said side skirts being sufficiently yielding to permit easy engagement and disengagement of the barbed side skirts with the base member.

3. A slide switch comprising a thin insulator base member having two end portions and an intermediate portion therebetween, a plurality of stationary contacts extending from one surface of the base member in said intermediate portion, a plurality of terminal means for said stationary contacts extending from the opposite surface of said base member, a sliding contact adapted for sliding engagement with said stationary contacts, a slidable housing member adapted to receive said sliding contact and hold it in engagement with one or more selected ones of said stationary contacts, said housing member being a unitary plastic piece having an upper portion extending transversely of said intermediate portion of the base member and including yieldable side skirts extending downwardly over the sides of said intermediate portion of the base member, one or more barb or latch elements at the lower portion of each side skirt and extending inwardly for slidingly engaging said opposite surface of the intermediate portion of said base member, stop means on said base member for limiting sliding movement of said housing member to the intermediate portion of said base member, said yieldable side skirts being spaced apart relative to the width of said intermediate portion of the base member to maintain said barbs or latching elements in sliding contact with the underside of the base member when said housing member and sliding contact are slid relative to the base member, and said side skirts being sufficiently yielding to permit easy engagement and disengagement of the barbed side skirts with the base member.

4. The combination claimed in claim 3 wherein said insulator base member is generally I-shaped, being comprised of opposite end portions of given widths and intermediate portion of reduced width.

5. A slide switch comprising a thin insulator base member having two end portions of given widths and an intermediate portion of reduced width located therebetween, slide stop means in said base member at the respective regions where the intermediate portion is contiguous to the end portions, a plurality of stationary contacts extending from one surface of the base member in said intermediate portion, a plurality of terminal means for said stationary contacts extending from the opposite surface of said base member, a resilient sliding contact adapted for sliding engagement with said stationary contacts, a slidable housing member adapted to hold said sliding contact in engagement with one or more selected ones of said stationary contacts, said housing member being a unitary molded plastic piece having an upper portion adapted to extend transversely over the intermediate portion of the base member and including yieldable side skirts adapted to extend downwardly over the side edges of the intermediate portion of reduced width of the base member, one or more barb or latch elements at the lower portion of each side skirt and each having a surface adapted to slidingly engage said opposite surface of the intermediate portion of said base member, said yieldable side skirts being spaced apart relative to the reduced width of the intermediate portion of the base member to maintain said barbs or latching elements in sliding contacts with said opposite surface of the base member when said housing member and sliding contact are slid on the base member between said slide stops, and said side skirts being sufficiently yielding to permit easy insertion and withdrawal therebetween of said intermediate portion of the base member.

6. The combination claimed in claim 5 wherein said insulator base member generally is I-shaped, said end portions and said intermediate portion meeting to form shoulders that serve as stops to limit sliding motion of said housing member.

7. The combination claimed in claim 5 and including actuator means associated with said housing member for applying an actuating force to said housing to slide said housing and sliding contact relative to the stationary contacts on the insulator base member.

8. The combination claimed in claim 6 and including means on the end portions of said insulator base member for securing the base member in a fixed position.

* * * * *